US005823121A

United States Patent [19]

Reiter

[11] Patent Number: 5,823,121

[45] Date of Patent: Oct. 20, 1998

[54] SPA TABLE

[76] Inventor: Dave Reiter, 3327 S. Monaco Pkwy. #E, Denver, Colo. 80222

[21] Appl. No.: 833,907

[22] Filed: Apr. 10, 1997

[51] Int. Cl.[6] ..... A47B 9/00

[52] U.S. Cl. ..... 108/147.19; 108/150; 4/496; 114/230; 446/153

[58] Field of Search ..... 108/50, 150, 161, 108/147.19, 144.11; 114/123, 230; 441/28, 125, 136, 35, 44; 4/496

[56] References Cited

U.S. PATENT DOCUMENTS

| | | | |
|---|---|---|---|
| 1,736,825 | 11/1929 | Griffin | 4/496 |
| 3,030,028 | 4/1962 | Hruby, Jr. | 4/496 |
| 3,619,833 | 11/1971 | Keller | 441/35 |
| 4,689,032 | 8/1987 | Trossman | 114/230 |
| 4,724,773 | 2/1988 | Newberry et al. | 108/150 |
| 5,465,677 | 11/1995 | Alter | 441/136 |

*Primary Examiner*—Peter M. Cuomo
*Assistant Examiner*—Gerald A. Anderson

[57] ABSTRACT

A new Spa Table for offering a portable table for use in a spa wherein the height of the table is self-adjusting such that the top of the table remains on the surface of the water. The inventive device includes a base member removably positioned on the floor of a spa, a planar table top member adapted to float on the water surface of the spa, and a self-adjusting vertical support member interconnecting the base member and the planar table top member, wherein the self-adjusting vertical support member self-adjusts to support the planar table top member in a generally horizontal position on the water surface of the spa. The planar table top member floats on the water surface of the spa such that the height of the planar table top member self-adjustingly correspondingly increases and decreases with the height of the water surface.

13 Claims, 3 Drawing Sheets

FIG.3
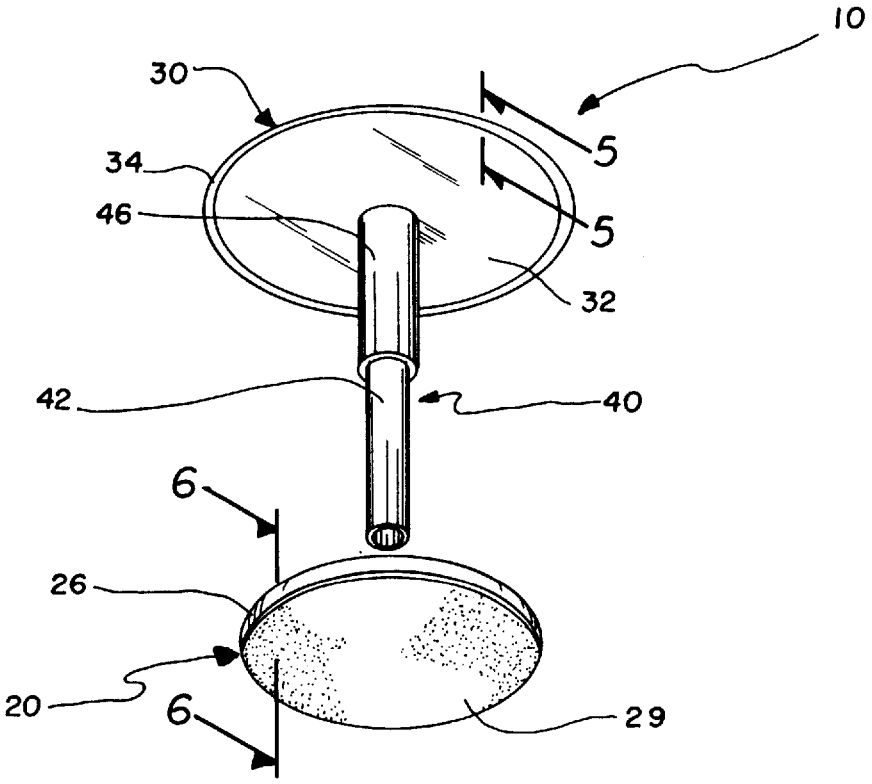
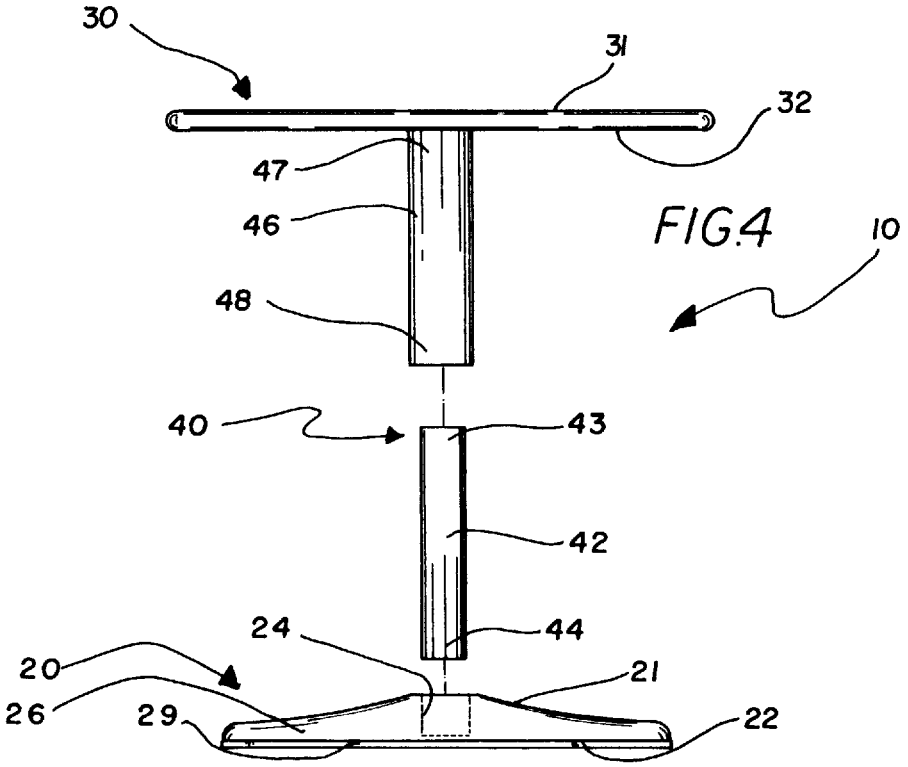
FIG.4

SPA TABLE

BACKGROUND OF THE INVENTION

1. Field of the Invention

The present invention relates to portable tables and more particularly pertains to a new Spa Table for offering a portable table for use in a spa wherein the height of the table is self-adjusting such that the top of the table remains on the surface of the water.

2. Description of the Prior Art

The use of portable tables is known in the prior art. More specifically, portable tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable tables include U.S. Pat. No. 4,724,773; U.S. Pat. No. 4,776,046; U.S. Patent D283,545; U.S. Patent D269,055; U.S. Patent D266,638 and U.S. Patent D267,272.

While these devices fulfill their respective, particular objectives and requirements, the aforementioned patents do not disclose a new Spa Table. The inventive device includes a base member removably positioned on the floor of a spa, a planar table top member adapted to float on the water surface of the spa, and a self-adjusting vertical support member interconnecting the base member and the planar table top member, wherein the self-adjusting vertical support member self-adjusts to support the planar table top member in a generally horizontal position on the water surface of the spa.

In these respects, the Spa Table according to the present invention substantially departs from the conventional concepts and designs of the prior art, and in so doing provides an apparatus primarily developed for the purpose of offering a portable table for use in a spa wherein the height of the table is self-adjusting such that the top of the table remains on the surface of the water.

SUMMARY OF THE INVENTION

In view of the foregoing disadvantages inherent in the known types of portable tables now present in the prior art, the present invention provides a new Spa Table construction wherein the same can be utilized for offering a portable table for use in a spa wherein the height of the table is self-adjusting such that the top of the table remains on the surface of the water.

The general purpose of the present invention, which will be described subsequently in greater detail, is to provide a new Spa Table apparatus and method which has many of the advantages of the portable tables mentioned heretofore and many novel features that result in a new Spa Table which is not anticipated, rendered obvious, suggested, or even implied by any of the prior art portable tables, either alone or in any combination thereof.

To attain this, the present invention generally comprises a base member removably positioned on the floor of a spa, a planar table top member adapted to float on the water surface of the spa, and a self-adjusting vertical support member interconnecting the base member and the planar table top member, wherein the self-adjusting vertical support member self-adjusts to support the planar table top member in a generally horizontal position on the water surface of the spa.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Spa Table apparatus and method which has many of the advantages of the portable tables mentioned heretofore and many novel features that result in a new Spa Table which is not anticipated, rendered obvious, suggested, or even implied by any of the prior art portable tables, either alone or in any combination thereof.

It is another object of the present invention to provide a new Spa Table which may be easily and efficiently manufactured and marketed.

It is a further object of the present invention to provide a new Spa Table which is of a durable and reliable construction.

An even further object of the present invention is to provide a new Spa Table which is susceptible of a low cost of manufacture with regard to both materials and labor, and which accordingly is then susceptible of low prices of sale to the consuming public, thereby making such Spa Table economically available to the buying public.

Still yet another object of the present invention is to provide a new Spa Table which provides in the apparatuses and methods of the prior art some of the advantages thereof, while simultaneously overcoming some of the disadvantages normally associated therewith.

Still another object of the present invention is to provide a new Spa Table for offering a portable table for use in a spa wherein the height of the table is self-adjusting such that the top of the table remains on the surface of the water.

Yet another object of the present invention is to provide a new Spa Table which includes a base member removably positioned on the floor of a spa, a planar table top member adapted to float on the water surface of the spa, and a self-adjusting vertical support member interconnecting the base member and the planar table top member, wherein the self-adjusting vertical support member self-adjusts to support the planar table top member in a generally horizontal position on the water surface of the spa.

Still yet another object of the present invention is to provide a new Spa Table that is portable and thus easily installed in and removed from a hot tub, spa, whirlpool, or jacuzzi.

Even still another object of the present invention is to provide a new Spa Table that provides a convenient surface on which individuals can place a variety of items (drinks, food, etc.) while in a hot tub, spa, whirlpool, or jacuzzi.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded illustration of the present invention.

FIG. 4 is an exploded illustration of the present invention.

DESCRIPTION OF THE PREFERRED EMBODIMENT

Figure 1:
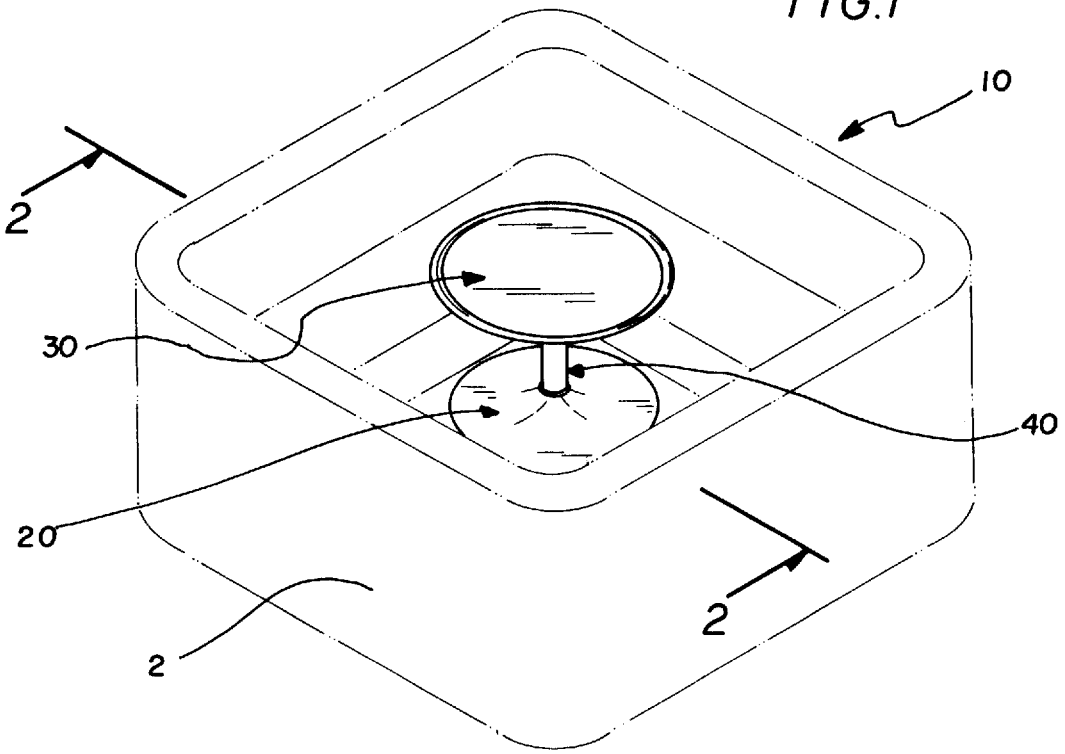
FIG. 1 is an illustration of a new Spa Table according to the present invention.

With reference now to the drawings, and in particular to FIGS. 1 through 6 thereof, a new Spa Table embodying the principles and concepts of the present invention and generally designated by the reference numeral 10 will be described.

More specifically, it will be noted that the Spa Table 10 comprises a base member 20 removably positioned on the floor 3 of a spa 2, a planar table top member 30 adapted to float on the water surface 9 of the spa 2, and a self-adjusting vertical support member 40 interconnecting the base member 20 and the planar table top member 30, wherein the self-adjusting vertical support member 40 self-adjusts to support the planar table top member 30 in a generally horizontal position on the water surface 9 of the spa 2.

Figure 2:
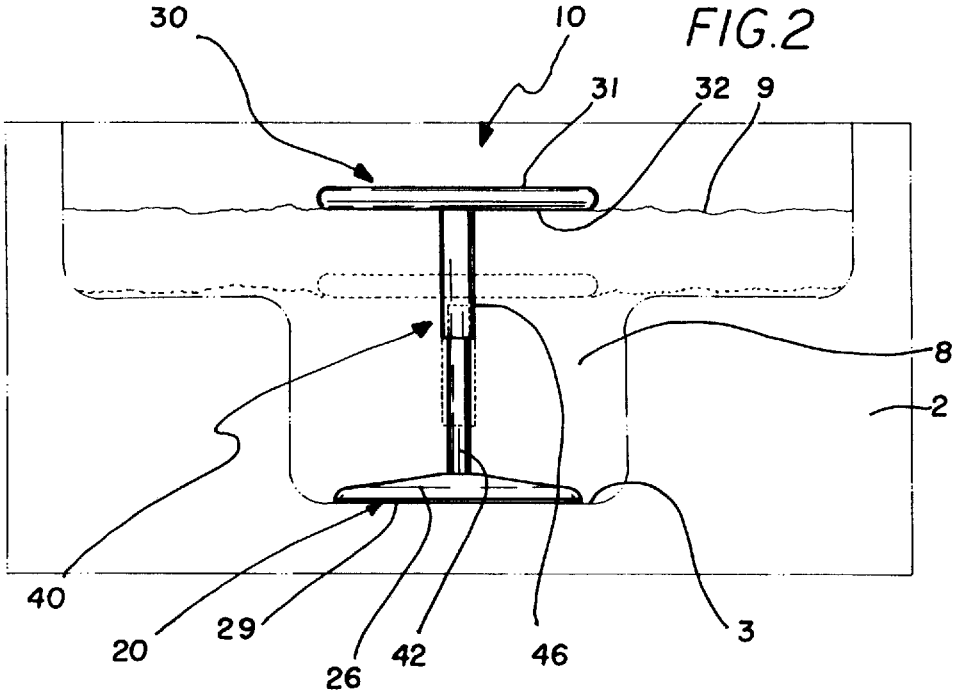
FIG. 2 is a top view of the present invention.

As best illustrated in FIGS. 1 and 2, it can be shown that the Spa Table 10 is intended for use in a spa 2. (It is noted that the term spa, as used herein, is intended to encompass hot tubs, whirlpools, Jacuzzis, and the like). The spa 2 includes a floor 3 and is filled with water 8 to create a water surface 9.

Figure 6:
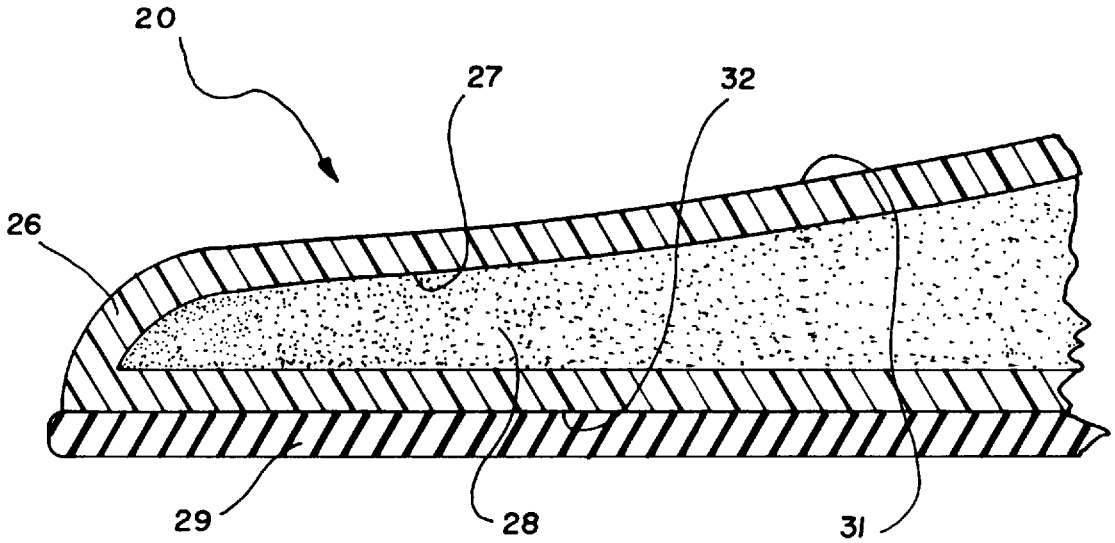
FIG. 6 is a cross sectional view taken along line 6–6 of FIG. 3.

As best illustrated in FIGS. 3 and 4, it can be shown that the base member 20 has a top surface 21 and a bottom surface 22. The top surface 21 of the base member 20 has a vertical support cavity 24 therein. A cushion member 29 is provided on the bottom surface 22 of the base member 20 for contact with the floor 3 of the spa 2. The cushion member 29 is preferably formed of rubber. As best illustrated in FIG. 6, it can be shown that the base member 20 comprises a shell member 26 having a hollow interior 27, and a granular material 28 having a density greater than that of water disposed within the hollow interior 27 of the shell member 26. The shell member 26 is preferably formed of plastic and the granular material is preferably sand such that the base member 20 rests on the floor 3 of the spa 2 when the spa 2 is filled with water 8.

Figure 5:
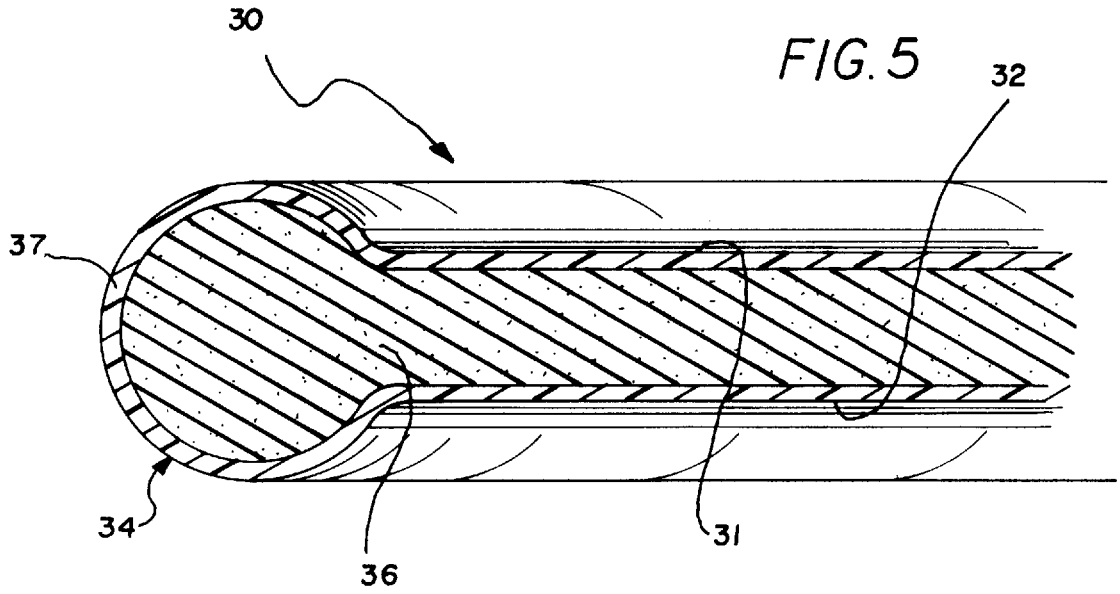
FIG. 5 a cross sectional view taken along line 5–5 of FIG. 3.

As best illustrated in FIGS. 3 and 4, it can be shown that the planar table top member 30 has a top surface 31 and a bottom surface 32. The planar table top member 30 includes a ridged portion 34 provided around a perimeter thereof. The ridged portion 34 helps to contain items placed on the top surface 31 of the planar table top member 30. As best illustrated in FIG. 5, it can be shown that the planar table top member 30 comprises an inner core member 36 and an outer shell member 37 encasing the inner core member 36. The inner core member 36 is formed of a material having a density less than that of water. The inner core member 36 is preferably formed of a rigid foam material (i.e., Styrofoam) and the outer shell member 37 is preferably formed of plastic such that the planar table top member 30 floats on the water surface 9 of the spa 2.

As best illustrated in FIGS. 3 and 4, it can be shown that the self-adjusting vertical support member 40 comprises an engaging member 42 removably coupled to the base member 20, and a sleeve member 46 secured to the planar table top member 30 and slidably engagingly coupled to the engaging member 42. As such, the planar table top member 30 is vertically self-adjustable towards and away from the base member 20. The engaging member 42 and the sleeve member 46 each have a first end 43 and 47, respectively, and a second end 44 and 48, respectively. The first end 47 of the sleeve member 46 is secured to the bottom surface 32 of the planar table top member 30 while the second end 48 of the sleeve member 46 slidably engagingly receives the first end 43 of the engaging member 42. The second end 44 of the engaging member 42 is removably inserted in the vertical support cavity 24 provided in the base member 20.

In use, the base member 20 is removably positioned on the floor 3 of the spa 2 and the self-adjusting vertical support member 40 extends upward from the base member 20 through the water 8 in the spa 2 and laterally restrains and supports the planar table top member 30. The planar table top member 30 floats on the water surface 9 of the spa 2 such that the height of the planar table top member 30 self-adjustingly correspondingly increases and decreases with the height of the water surface 9. As such, the planar table top member 30 provides a convenient surface on which individuals can place a variety of items (drinks, food, etc.) while in the spa 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, a redeemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-adjusting portable table for use in a spa having a floor and being filled with water to create a water surface, said self-adjusting portable table comprising:

a base member, said base member being adapted for positioning on the floor of the spa;

a planar table top member having a substantially planar top surface, said table top member being adapted to float on the water surface of the spa; and a self-adjusting vertical support member interconnecting said base member and said planar table top member, said self-adjusting vertical support member being adapted for supporting said planar table top member in a generally horizontal position on the water surface of the spa; wherein said self-adjusting vertical support member comprises:

an engaging member, said engaging member being removably coupled to said base member, and a sleeve member, said sleeve member being secured to said planar table top member, wherein said engaging member and said sleeve member are slidably telescopically coupled together such that said sleeve member slides freely over said engaging member, whereby said planar table top member is vertically self-adjustable towards and away from said base member corresponding to changes in a distance between the floor of the spa and the water surface of the spa.

2. The self-adjusting portable table of claim 1, wherein said base member comprises:

a shell member having a hollow interior, and a granular material having a density greater than that of water disposed within said hollow interior of said shell member.

3. The self-adjusting portable table of claim 2, wherein said shell member is formed of plastic and wherein said granular material is sand, said hollow shell member containing a sufficient amount of said sand such that said base member rests on the floor of the spa when said spa is filled with water.

4. The self-adjusting portable table of claim 1, wherein said planar table top member comprises:

an inner core member, said inner core member being formed of a material, said material having a density less than that of water, and an outer shell member encasing said inner core member.

5. The self-adjusting portable table of claim 4, wherein said inner core member is formed of a rigid foam material and wherein said outer shell material is formed of plastic.

6. The self-adjusting portable table of claim 1, wherein said planar table top member includes a ridged portion, said ridged portion being provided around a perimeter of said planar table top member.

7. The self-adjusting portable table of claim 1, wherein said base member has a top surface and a bottom surface, said top surface having a vertical support cavity therein, wherein said planar table top member has a bottom surface, and wherein said engaging member and said sleeve member each have a first end and a second end, said first end of said sleeve member secured to said bottom surface of said planar table top member, said second end of said sleeve member slidably engagingly receiving said first end of said engaging member, said second end of said engaging member removably inserted in said vertical support cavity provided in said base member.

8. The self-adjusting portable table of claim 7, further comprising:

a cushion member provided on said bottom surface of said base member, said cushion member being for contacting the floor of the spa.

9. The self-adjusting portable table of claim 8, wherein said cushion member is formed of rubber.

10.A self-adjusting portable table for use in a spa having a floor and being filled with water to create a water surface, said self-adjusting portable table comprising:

a base member removably positioned on said floor of said spa;

a planar table top member adapted to float on said water surface of said spa; and a vertically self-adjusting support member extending upwardly from said base member through said water in said spa and laterally restraining said planar table top member, said planar table top member floating on said water surface of said spa such that the height of said planar table top member self-adjustingly correspondingly increases and descreses with the height of said water surface.

11. A self-adjusting portable table for use in a spa having a floor and being filled with water to create a water surface, said self-adjusting portable table comprising:

a base member removably positioned on said floor of said spa;

a planar table top member being adapted to float on said water surface of said spa, said planar table top member having a substantially planar top surface and a bottom surface;

an engaging member removably coupled to said base member; and a sleeve member being secured to said bottom surface of said planar table top member at one end of said sleeve member such that said sleeve member is slidably and engagingly coupled to said engaging member at an opposite end of said sleeve member such that said sleeve member slides freely over said engaging member, whereby said planar table top member is vertically adjustable towards and away from said base members whereby said planar table top member floats on the water surface of the spa.

12. The self-adjusting portable table of claim 11, wherein said base member comprises:

a shell member having a hollow interior, and a material having a density greater than that of water disposed within said hollow interior of said shell member, whereby said base member is adapted to rest on the floor of the spa when the spa is filled with water.

13. The self-adjusting portable table of claim 11, wherein said planar table top member comprises:

an inner core member formed of a material having a density less than that of water, and an outer shell member encasing said inner core member, whereby said planar table top member floats on the water surface of the spa.

* * * * *